United States Patent [19]

Kemper

[11] Patent Number: 5,075,933

[45] Date of Patent: Dec. 31, 1991

[54] CABLE LOCKING AND RETAINING DEVICE

[76] Inventor: Kenneth L. Kemper, 135 33rd Ave. SW. #5, Cedar Rapids, Iowa 52404

[21] Appl. No.: 542,525

[22] Filed: Jun. 25, 1990

[51] Int. Cl.[5] ..... B65D 63/00

[52] U.S. Cl. ..... 24/16 R; 24/306; 24/442

[58] Field of Search ..... 24/16 R, 17 AP, 17 B, 24/442, 306, 447, DIG. 11; 128/DIG. 15; 2/DIG. 6

[56] References Cited

U.S. PATENT DOCUMENTS

| | | | |
|---|---|---|---|
| 3,543,977 | 12/1970 | Lockridge | 128/DIG. 15 |
| 3,640,273 | 2/1972 | Ray | 128/DIG. 15 |
| 3,835,505 | 9/1974 | Schewbridge | 24/16 R |
| 3,994,048 | 11/1976 | Rosenthal | 24/16 R |
| 4,862,563 | 9/1989 | Flynn | 24/306 |
| 4,893,381 | 1/1990 | Frankel | 24/442 |

OTHER PUBLICATIONS

Cable Lock; Lelan Company; one sheet; FIG. 1; no date; but sold more than one year before Jun. 25, 1990, the filing date of this application Ser. No. 542,525.

*Primary Examiner*—Victor N. Sakran

[57] ABSTRACT

A strap type retainer with loop and hook material on opposite sides which can be used to store cords and other devices which has a pair of welds at one end adjacent a ring such that one end of a cord can be attached by a flap below the ring.

1 Claim, 1 Drawing Sheet

CABLE LOCKING AND RETAINING DEVICE

BACKGROUND OF THE INVENTION

1. Field of the Invention

This invention relates in general to retainers and, in particular to a novel cable locking and retaining device which can be used for cables, hoses, snow skis, water skis, camera tripods and other devices.

2. Description of Related Art

The cable locking device previously manufactured and sold by the assignee of the present invention comprised a strip of loop or hook materal at one end of which was attached a ring by a weld and the same weld was used to attach a short strip of hook or loop material adjacent the ring. However, such prior art device did not provide sufficient space between the ring and the weld contact point of the short strip to allow the short strip to encircle a cord wherein the encirclement of the short strip was substantially between the ring and the weld. This resulted in inadequate space for the cord.

SUMMARY OF THE INVENTION

The present invention comprises an improvement on the prior cable lock retaining device wherein the cord retainer flap is attached by using a second weld which is spaced from the first weld which attaches the retaining ring such that the space between the first and second weld provides a "cord channel" so that the cord can be positively attached to the cable lock retaining device between the first and second welds in the cord channel so as to substantially permanently attach the cable locking retainer device to the cord.

The present invention also is an improvement over the prior art device in that the actual nature of the welds in the material are cleaner and result in a more flexible portion of the retainer in the weld area than those of the prior art device which were substantially rigid.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
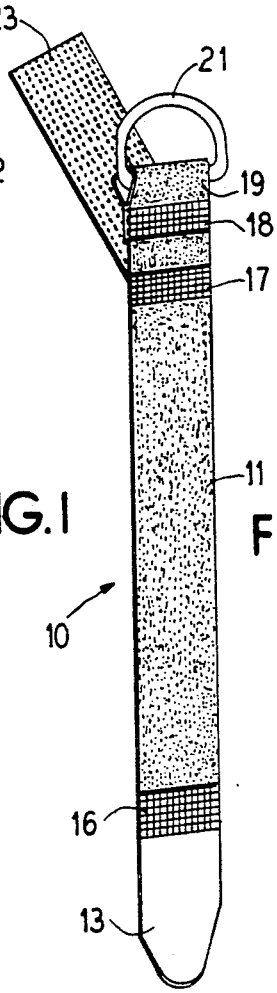
FIG. 1 is a plan view showing one side of the cable lock retaining device.
Figure 2:
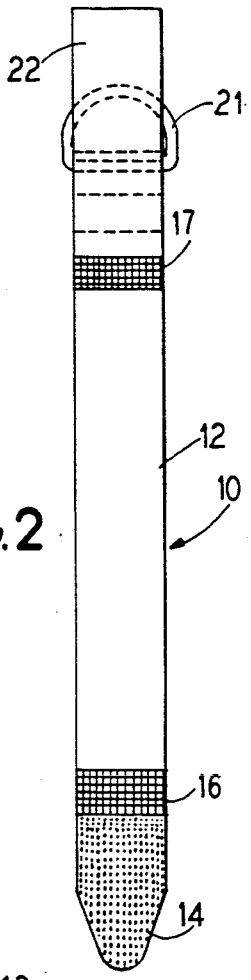
FIG. 2 is a plan view showing a second side of the cable lock retaining device.
Figure 3:
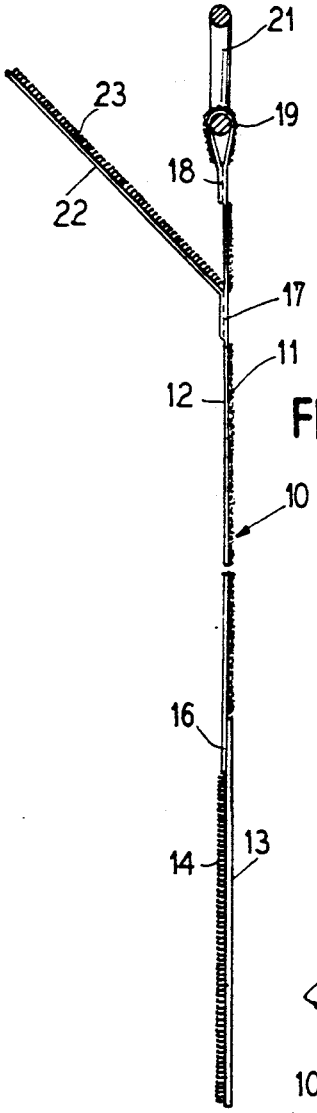
FIG. 3 is a side view showing the cable lock retaining device.

FIGS. 1, 2 and 3 illustrate the novel cable lock retaining means 10 of the invention which has a main or central extending portion 12 which has a working side 11 of loop material such as Velcro (TM). An end portion 13 is connected to the central portion 12 by a weld 16 such that on the loop side 11 the end 13 has a back side and the other side 14 comprises a working side of hook material. In other words, the hook side 14 of end portion 13 is reversed relative to the loop side 11 of the central portion 12. At the other end of central portion 12, a weld 17 connects a flap 22 which has a side 23 that comprises a working side of hook material. Another weld 18 is spaced a distance D from the weld 17 and joins the end of central portion 12 to itself so as to form a loop 19 around a ring 21.

Figure 4:
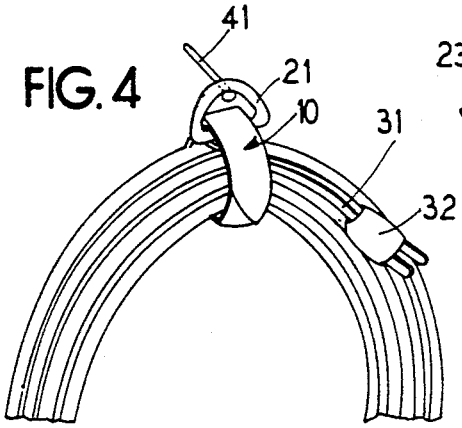
FIG. 4 illustrates the invention in use holding a coil of electrical conductor or cable.
Figure 5:
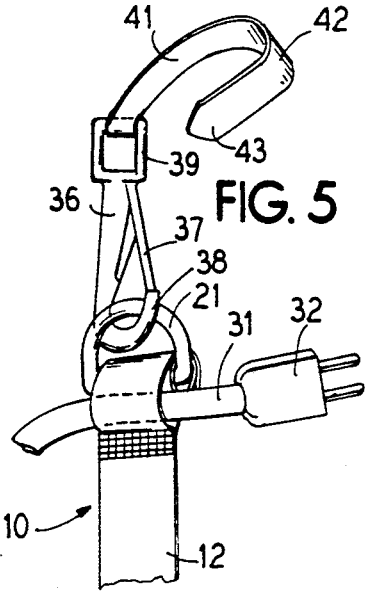
FIG. 5 illustrates the invention connected to a belt attaching member.
Figure 6:
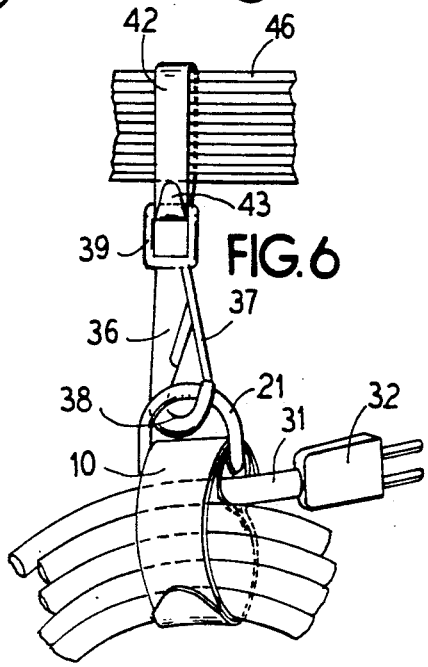
FIG. 6 illustrates the invention attached to a belt.

The spacing D between the welds 17 and 18 allow the flap 22 to be wrapped around a power cord 31 as shown in FIGS. 5 and 6, for example, such that the power cord 31 substantially fits between the welds 17 and 18 and the flap 22 can pass over the cord 31 and through the ring 21 so that its working side 23 of hook material can be joined with the loop side 11 of the central portion 12 to attach the flap 22 and firmly attach the cord 31 to the retainer 10. As shown, one end of the cord 31 is adjacent the ring 21. The remaining portion of the cord 31 is coiled and the end 13 of the strap is passed around the cord with the working side 11 of loop material on the outside and then the end 13 is passed through the ring 21 so that the central portion 12 is around the coiled cord 33 and the end 13 is passed through the ring 21 and the working side of hook material 14 is attached to the work side of loop material 11 of the strap 12 as shown, for example, in FIG. 4. The hook side 14 locks the strap about the coiled cord 33 and the cord 33 can be hung on a nail 41 as shown in FIG. 4. Alternatively, the hook 21 can be connected to a belt lock which contains a hook 36 with a curved portion 38, a retainer 37 and an eye 39 through which a strap 41 is attached and which has an end 43. One side 42 of the strap 41 may have a working side of loop material and the end 43 may have a portion with a working side of hook material so that it can be extended around a belt 46 and through the eye 39 of the hook 36 so as to attach the belt lock to the belt 46.

The principle features of the present invention is in providing that the flap 22 is attached to the strap 11 by a weld 17 which is spaced a substantial distance equal to or greater than the transverse dimension of a device to retain space from the the ring 21 to the strap 11. This allows sufficient space for the cable 31 to be firmly attached to the upper end of the strap by the flap 22 as shown in FIGS. 5 and 6. Prior art devices do not provide sufficient distance so as to allow the cable 31 to be mounted in the space below the ring 21 as shown in FIGS. 5 and 6. The flap 22 is semipermanently connected to the cable 31 such that when the cable is uncoiled by removing the working side 14 of hook material from the working side 11 of loop material of the strap 12 so that the cable can be uncoiled, the retainer 10 will remain connected to the cable portion 31 adjacent the end 32 so as to be ready for use when the cable is to be recoiled and stored.

The invention allows cords and cables to be hung on a nail or peg 41 without sharp bends or kinks so that the cord will last longer and can be neatly stored.

The retainer 10 of the invention can be made in various lengths for different purposes. For example, a length of 8 inches is useful for power tool cords, appliance cords, computer cables and power cords up to about 50 feet in length. A length of 14 inches is useful for small garden hoses, jumper cables and power cords up to 100 feet. A length of 24 inches can be used for larger hoses, water or snow skis, for bicycles and heavy duty applications. A length of 36 inches can be used for boat sails, tie-downs and other applications.

It is to be realized the working loop and hook sides can be interchanged in the invention to obtain the equivalent results.

Also, the welds 17 and 18 and 16 are formed so that they are substantially flexible and such flexible welds result in a much more practical and useful device than the rigid welds of the prior art.

Although the invention has been described with respect to preferred embodiments, it is not to be so limited as changes and modifications can be made which are within the full intended scope of the invention as defined by the appended claims.

I claim as my invention:

1. A flexible retainer strap for a cable comprising a sufficient length to form a first loop around a coiled cable, an elongated central portion with a working side of loop material on one side, and end portion attached to a first end of said elongated central portion and with a working side of hook material which is on a side that is opposite to the working side of said loop material on said central portion, a D-ring attached to a second end of said central portion by a first weld, a flap with a working side of hook material connected to said central portion at a distance "D" from said ring such that said flap can be passed around said cable and then passed through said D-ring and the working hook side of said flap can be attached to the working side of loop material of said central portion, said distance "D" is large enough to allow said flap to hold the end of said coiled cable against said central portion below and adjacent to said D-ring, and along the outside of said first loop, wherein said flap and said central portion are made of plastic and said flap is joined to said central portion by a first weld, wherein said D-ring is joined to said central portion by a second weld, and wherein the distance of the edge of said first weld to said D-ring is greater than the transverse dimension of said cable and second means passing through said D-ring for supporting said cable.

* * * * *